US010821332B1

(12) United States Patent
Chen et al.

(10) Patent No.: US 10,821,332 B1
(45) Date of Patent: Nov. 3, 2020

(54) CASTING METHOD FOR MANUFACTURING GOLF CLUB HEAD HAVING WEIGHT MEMBER AND GOLF CLUB HEAD MANUFACTURED THEREBY

(71) Applicant: ADVANCED INTERNATIONAL MULTITECH CO., LTD., Kaohsiung (TW)

(72) Inventors: Min-Tsung Chen, Kaohsiung (TW); Shang-Ju Tsai, Kaohsiung (TW); Ming-Fu Su, Kaohsiung (TW); Kun-Han Lu, Kaohsiung (TW); Ming-Wei Huang, Kaohsiung (TW); Chun-Hao Huang, Kaohsiung (TW)

(73) Assignee: ADVANCED INTERNATIONAL MULTITECH CO., LTD., Kaohsiung (TW)

( * ) Notice: Subject to any disclaimer, the term of this patent is extended or adjusted under 35 U.S.C. 154(b) by 0 days.

(21) Appl. No.: 16/569,317

(22) Filed: Sep. 12, 2019

(30) Foreign Application Priority Data

Jul. 17, 2019 (TW) ..... 108125236 A

(51) Int. Cl.

| | |
|---|---|
| ***A63B 53/04*** | (2015.01) |
| ***B22C 7/02*** | (2006.01) |
| ***B22D 19/00*** | (2006.01) |
| ***B22C 9/22*** | (2006.01) |
| *B22C 9/04* | (2006.01) |

(52) U.S. Cl.
CPC ..... *A63B 53/04* (2013.01); *B22C 7/02* (2013.01); *B22C 9/22* (2013.01); *B22D 19/00* (2013.01); *A63B 53/0466* (2013.01); *A63B 2053/0491* (2013.01); *A63B 2209/00* (2013.01); *B22C 9/04* (2013.01); *B22C 9/043* (2013.01)

(58) Field of Classification Search
CPC ..... A63B 2053/0491; A63B 53/04; A63B 53/0466; B22C 9/04; B22C 9/043; B22C 9/046
USPC ..... 473/335, 336, 338, 339, 345, 349
See application file for complete search history.

(56) References Cited

U.S. PATENT DOCUMENTS

| | | | | |
|---|---|---|---|---|
| 5,595,548 A * | 1/1997 | Beck | B22D 19/00 | 473/324 |
| 5,836,830 A * | 11/1998 | Onuki | A63B 53/04 | 473/349 |
| 2012/0202615 A1* | 8/2012 | Beach | A63B 53/0466 | 473/338 |

* cited by examiner

*Primary Examiner* — Benjamin Layno
(74) *Attorney, Agent, or Firm* — Muncy, Geissler, Olds & Lowe, P.C.

(57) ABSTRACT

A method for manufacturing a golf club head having a weight member includes: providing a weight block made of a metal material; disposing an isolation layer on the weight block to form the weight member; delivering a wax material to form a wax pattern covering a portion of the weight member; coating the weight member and the wax pattern with a shell mold plaster to form a shell mold covering the same; performing a de-waxing process which leaves a mold cavity in the shell mold; and casting a molten metal material in the mold cavity to form a club head main body, and removing the shell mold to form the golf club head having the weight member embedded in the club head main body. A golf club head manufactured by the method is also disclosed.

9 Claims, 5 Drawing Sheets

CASTING METHOD FOR MANUFACTURING GOLF CLUB HEAD HAVING WEIGHT MEMBER AND GOLF CLUB HEAD MANUFACTURED THEREBY

CROSS-REFERENCE TO RELATED APPLICATION

This application claims priority of Taiwanese Patent Application No. 108125236, filed on Jul. 17, 2019.

FIELD

The present disclosure relates to a casting method for manufacturing a golf club head having a weight member, as well as a golf club head manufactured thereby.

BACKGROUND

Gravity center of a golf club head of a golf club affects travelling distance of a golf ball and handling of the golf club by a user during striking of the golf ball. To adjust the total weight and the gravity center of the golf club head, a heterogeneous weight block is disposed in a club head main body of the golf club head and is fixedly connected thereto by conventional methods such as soldering, lock fitting and binding via an adhesive. However, each of these conventional methods has its own shortcoming. For example, due to the weight block being made of a material different from that of the club head main body, the soldering method often leads to defects such as the presence of gaps and inefficient connection therebetween, resulting in poor quality of the thus manufactured golf club head. Likewise, the lock fitting method requires a lock fitting structure to be designed onto the club head main body, which would occupy space and thus limits the flexibility to mold the shape of the golf club head. In addition, binding via the adhesive to connect the weight block to the club head main body might lead to insufficient structural strength.

In view of the abovementioned shortcomings, another conventional method to fixedly connect the weight block to the club head main body is developed, in which the weight block is disposed during a casting process to mold the club head main body, such that the weight block is embedded in the club head main body. This method not only increases structural strength between the weight block and the club head main body, but also allows efficient use of space, thereby enhancing the flexibility of molding the club head main body. Nevertheless, since the weight block is mostly made of a metal alloy having a high specific gravity, during the casting process conducted at high temperature, a molten metal material for forming the club head main body might easily react with the weight block, resulting in oxidation of the weight block, which in turn interferes with the molding and formation of the club head main body and impairs the quality of the golf club head to be manufactured.

SUMMARY

Therefore, an object of the present disclosure is to provide a casting method for manufacturing a golf club head having a weight member that can alleviate at least one of the drawbacks of the prior art.

Another object of the present disclosure is to provide a golf club head that can alleviate at least one of the drawbacks of the prior art.

According to the present disclosure, the casting method for manufacturing a golf club head having a weight member includes the steps of:

(A) providing a weight block made of a metal material;

(B) disposing on the weight block an isolation layer that is resistant to high temperature and oxidation so as to form the weight member, wherein the weight block is covered by the isolation layer;

(C) positioning the weight member inside a mold, followed by delivering a wax material into the mold so as to form a wax pattern that covers a portion of the weight member;

(D) removing the weight member and the wax pattern from the mold and coating the weight member and the wax pattern with a shell mold plaster that has a melting point higher than that of the wax material so as to form a shell mold that covers the wax pattern and the weight member;

(E) performing a de-waxing process for removal of the wax material, which leaves a mold cavity in the shell mold, the weight member being fixedly positioned inside the shell mold; and (F) casting a molten metal material in the mold cavity of the shell mold to form a club head main body, followed by removing the shell mold to form the golf club head, wherein the weight member is embedded in the club head main body.

According to the present disclosure, the golf club head, which may be manufactured by the abovementioned casting method, includes a club head main body and a weight member that is embedded in the club head main body. The weight member includes a weight block made of a metal material and an isolation layer that covers the weight block and that is resistant to high temperature and oxidation. The isolation layer is disposed between the club head main body and the weight block.

BRIEF DESCRIPTION OF THE DRAWINGS

Other features and advantages of the present disclosure will become apparent in the following detailed description of the embodiments with reference to the accompanying drawings, of which.

DETAILED DESCRIPTION

Figure 1:
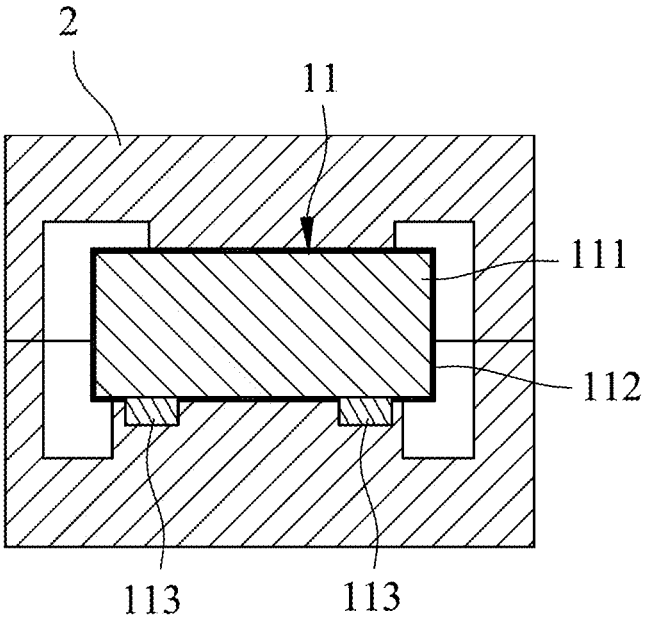
FIG. 1 is a sectional schematic view illustrating an isolation layer being disposed on a weight block so as to form a weight member.

Before the present disclosure is described in greater detail, it should be noted that where considered appropriate, reference numerals or terminal portions of reference numerals have been repeated among the figures to indicate corresponding or analogous elements, which may optionally have similar characteristics.

According to the present disclosure, an embodiment of a casting method for manufacturing a golf club head 1 having a weight member 11 (see FIG. 7) includes the following steps A to F.

In step A, as illustrated in FIG. 1, a weight block 111 made of a metal material is provided. In this embodiment, the metal material for making the weight block 111 is a tungsten alloy, but is not limited thereto.

In step B, an isolation layer 112 that is resistant to high temperature and oxidation is disposed on and covers the weight block 111 so as to form the weight member 11 (see FIG. 1). The isolation layer 112 may be a layered material that includes, but is not limited to, a vacuum deposited film layer, a zirconia sand layer, a ceramic layer, and an electroplated film layer. The isolation layer 112 may also be made of other materials capable of preventing the formation of oxides through oxidation of the weight block 111. In certain embodiments, the weight member 11 further includes a plurality of positioning bars 113 that penetrate the weight block 111 and the isolation layer 112, and that are configured to position the weight block 111 in a mold 2 (see FIG. 2). In this embodiment, the number of the positioning bars 113 is two, but is not limited thereto and may vary to meet actual requirements.

Figure 2:
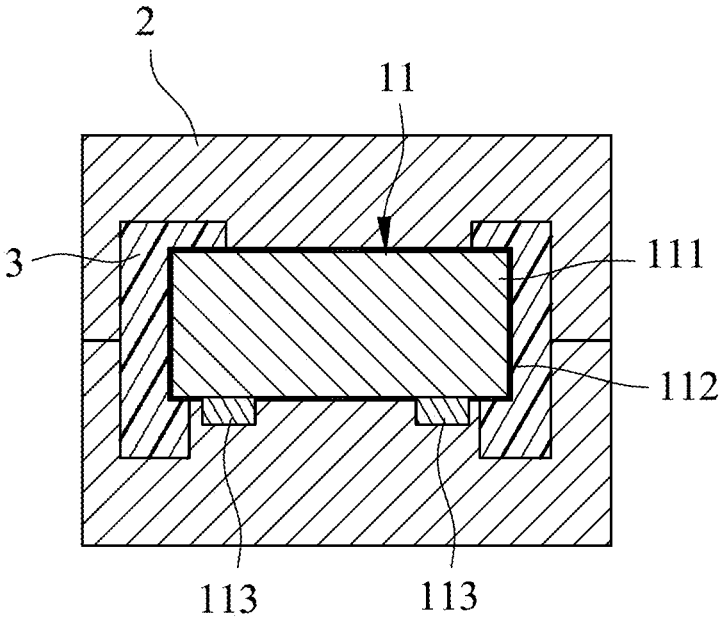
FIG. 2 is a sectional schematic view illustrating the weight member being positioned inside a mold, followed by a wax material being delivered into the mold to form a wax pattern.
Figure 3:
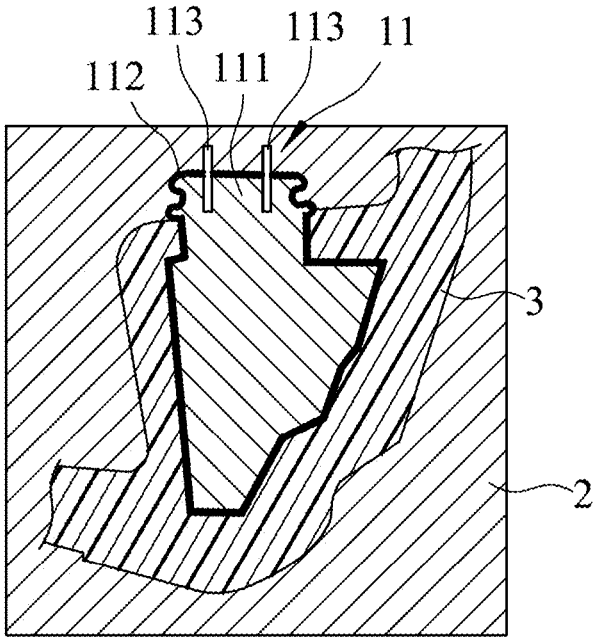
FIG. 3 is a fragmentary sectional view illustrating a portion of the weight member being covered by the wax pattern in the mold.

In step C, the weight member 11 is fixedly positioned inside the mold 2 by a clamping action of the mold 2, followed by delivering a wax material into the mold 2 so as to form a wax pattern 3 that covers a portion of the weight member 11, but does not cover the positioning bars 113 (see FIGS. 1 to 3). In this embodiment, the positioning bars 113 are fixedly positioned inside the mold 2, so as to assist in positioning the weight block 111 in the mold 2.

Figure 4:
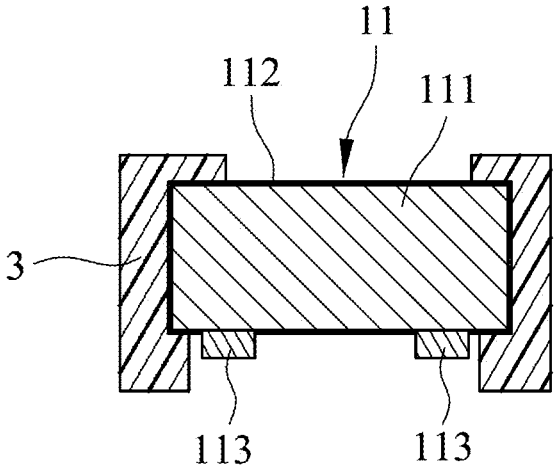
FIG. 4 is a sectional schematic view illustrating the weight member and the wax pattern being removed from the mold.
Figure 5:
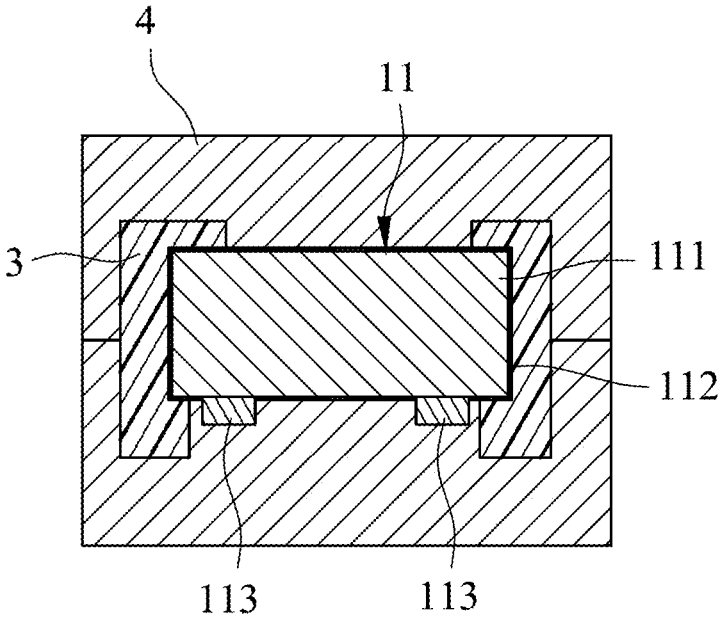
FIG. 5 is a sectional schematic view illustrating the weight member and the wax pattern being coated with a shell mold plaster to form a shell mold that covers the wax pattern and the weight member.

In step D, as illustrated in FIG. 4, the weight member 11 and the wax pattern 3 are removed from the mold 2. Then, the weight member 11 and the wax pattern 3 are coated with a shell mold plaster that has a melting point higher than that of the wax material so as to form a shell mold 4 that covers the wax pattern 3 and the weight member 11 (see FIG. 5). The weight member 11 may be fixedly positioned in the shell mold 4, e.g., by a clamping action of the shell mold 4.

Figure 6:
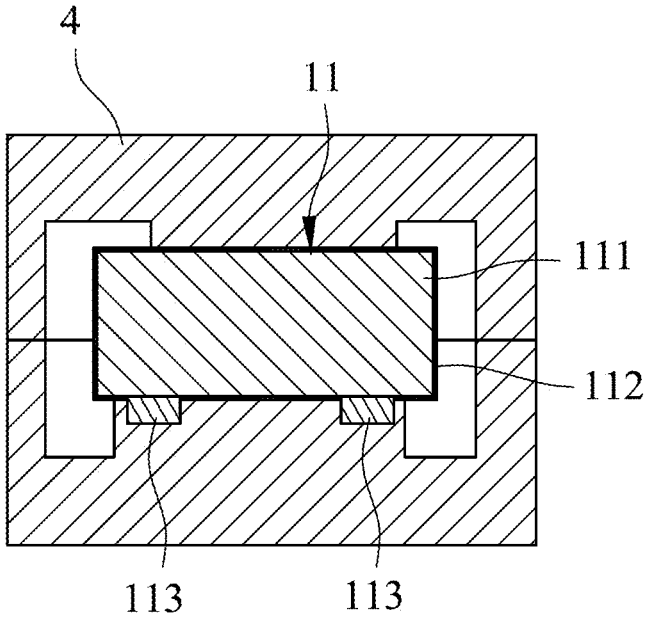
FIG. 6 is a schematic sectional view illustrating a de-waxing process being performed, which leaves a mold cavity in the shell mold.

In step E, a de-waxing process is performed for removal of the wax material, which leaves a mold cavity in the shell mold 4, and the weight member 11 that includes the positioning bars 113 are fixedly positioned inside the shell mold 4 (see FIG. 6).

Figure 7:
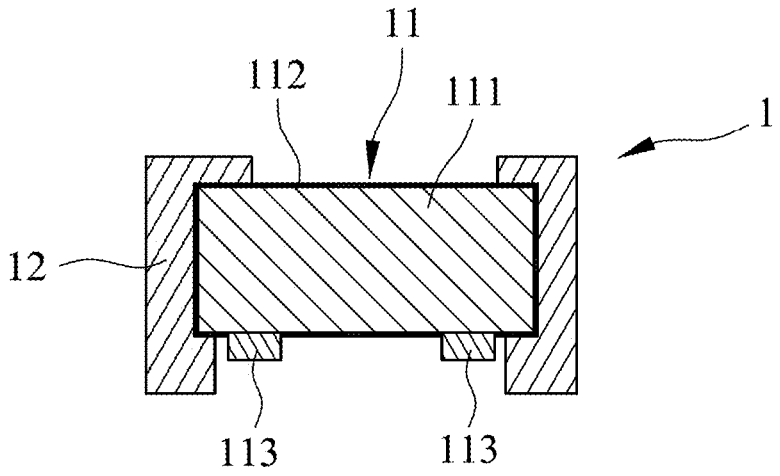
FIG. 7 is a sectional schematic view illustrating a molten metal material being casted in the mold cavity, followed by removing the shell mold so as to form an embodiment of a golf club head.

Referring to FIGS. 6 and 7, in step F, a molten metal material is casted in the mold cavity of the shell mold 4 to form a club head main body 12, followed by removing the shell mold 4 so as to form an embodiment of the golf club head 1.

Figure 9:
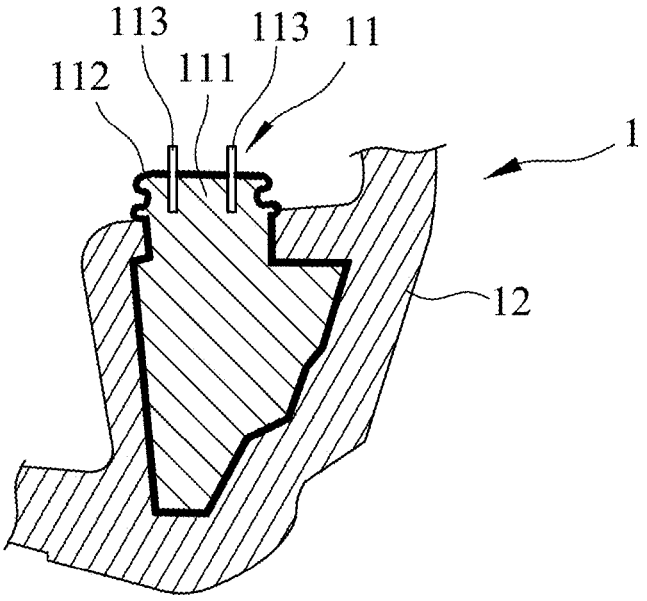
FIGS. 9 and 10 are fragmentary sectional views illustrating a portion of the weight member being embedded in a club head main body of the golf club head shown in FIGS. 7 and 8, respectively.

Referring to FIG. 9, the embodiment of the golf club head 1 that is manufactured by the casting method as mentioned above includes the club head main body 12, and the weight member 11 that is embedded in the club head main body 12. The weight member 11 includes the weight block 111 made of the metal material as mentioned above, and the isolation layer 112 that covers the weight block 111 and that is resistant to high temperature and oxidation. The isolation layer 112 is disposed between the club head main body 12 and the weight block 111. The weight member 11 further includes a plurality of positioning bars 113 that penetrate the weight block 111 and the isolation layer 112. The positioning bars 113 are not covered by the club head main body 12.

Figure 8:
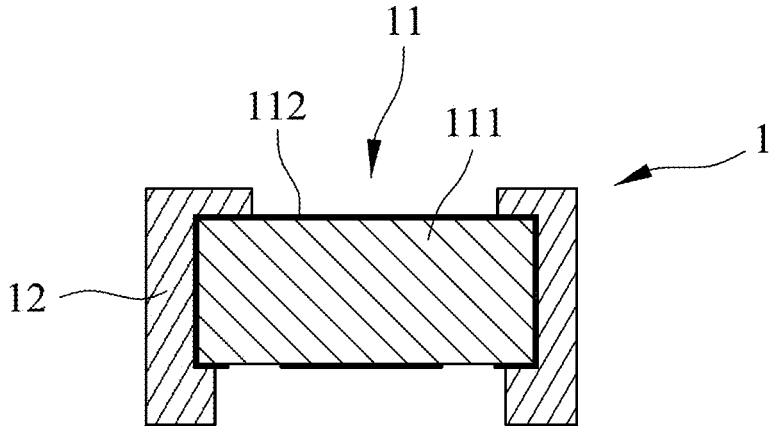
FIG. 8 is a sectional schematic view illustrating the positioning bars being removed to form a variation of the embodiment of the golf club head shown in FIG. 7.
Figure 10:
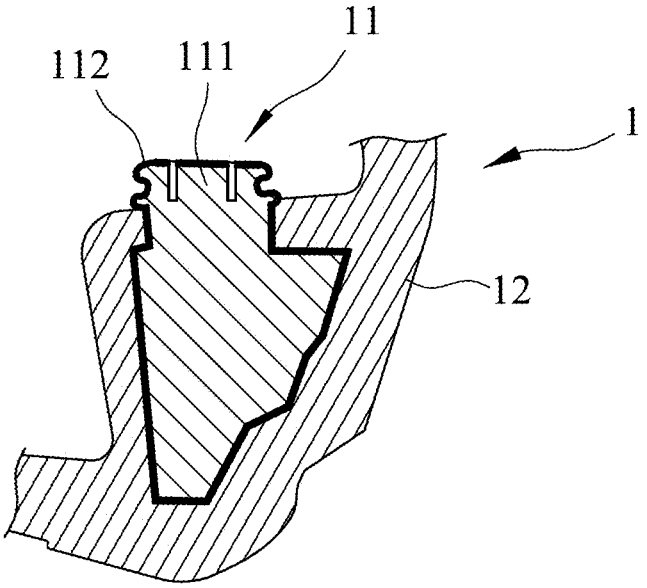

With reference to FIGS. 8 and 10, the casting method of the present disclosure may further include removing the positioning bars 113 after the shell mold 4 is removed, so as to form a variation of the embodiment of the golf club head 1. In other embodiments, the positioning bars 113 are removed before the formation of the shell mold 4. The space left by the removal of the positioning bars 113 may be optionally filled with the metal material according to practical requirements.

It should be noted that, the number of the weight member 11 is not limited to the embodiment described herein, and may vary to meet actual requirements. For example, a plurality of the weight members 11 may be embedded in the club head main body 12 using the abovementioned casting method.

In summary, by virtue of covering the weight block 111 with the isolation layer 112 that is resistant to high temperature and oxidation, the weight block 111 is prevented from being oxidized at excessively high temperature during casting of the club head main body 12, such that the club head main body 12 is molded completely, thereby the quality and stability of the thus manufactured golf club head 1 is improved.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the present disclosure has been described in connection with what is considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A casting method for manufacturing a golf club head having a weight member, comprising the steps of:

(A) providing a weight block made of a metal material;

(B) disposing on the weight block an isolation layer that is resistant to high temperature and oxidation so as to form the weight member, wherein the weight block is covered by the isolation layer;

(C) positioning the weight member inside a mold, followed by delivering a wax material into the mold so as to form a wax pattern that covers a portion of the weight member;

(D) removing the weight member and the wax pattern from the mold and coating the weight member and the wax pattern with a shell mold plaster that has a melting point higher than that of the wax material so as to form a shell mold that covers the wax pattern and the weight member;

(E) performing a de-waxing process for removal of the wax material, which leaves a mold cavity in the shell mold, the weight member being fixedly positioned inside the shell mold; and (F) casting a molten metal material in the mold cavity of the shell mold to form a club head main body, followed by removing the shell mold to form the golf club head, wherein the weight member is embedded in the club head main body, wherein in step (B), the weight member further includes a plurality of positioning bars that penetrate the weight block and the isolation layer; in step (C), the positioning bars are fixedly positioned in the mold and the positioning bars are not covered by the wax material; in step (E), the positioning bars are fixedly positioned in the shell mold; and in step (F), the positioning bars are not covered by the club head main body.

2. The casting method as claimed in claim 1, wherein in step (B), the isolation layer is a layered material selected from the group consisting of a vacuum deposited film layer, a zirconia sand layer, a ceramic layer, and an electroplated film layer.

3. The casting method as claimed in claim 2, wherein in step (A), the metal material for making the weight block is a tungsten alloy.

4. The casting method as claimed in claim 2, wherein in step (C), the weight member is fixedly positioned in the mold by a clamping action of the mold.

5. The casting method as claimed in claim 1, wherein in step (F), the positioning bars are removed after the shell mold is removed.

6. A golf club head manufactured by the casting method as claimed in claim 1, comprising:

the club head main body; and the weight member embedded in the club head main body, said weight member including the weight block made of the metal material and the isolation layer that covers said weight block and that is resistant to high temperature and oxidation, said isolation layer being disposed between said club head main body and said weight block.

7. The golf club head as claimed in claim 6, wherein said isolation layer is a layered material selected from the group consisting of a vacuum deposited film layer, a zirconia sand layer, a ceramic layer, and an electroplated film layer.

8. The gold club head as claimed in claim 7, wherein the metal material for making said weight block is a tungsten alloy.

9. The golf club head as claimed in claim 6, wherein said weight member further includes a plurality of positioning bars that penetrate said weight block and said isolation layer.

* * * * *